US009778587B2

(12) United States Patent
Tominaga et al.

(10) Patent No.: US 9,778,587 B2
(45) Date of Patent: Oct. 3, 2017

(54) IMAGE FORMING APPARATUS

(71) Applicant: FUJI XEROX CO., LTD., Tokyo (JP)

(72) Inventors: Yoshiyuki Tominaga, Kanagawa (JP); Sho Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/214,515

(22) Filed: Jul. 20, 2016

(65) Prior Publication Data

US 2017/0248864 A1 Aug. 31, 2017

(30) Foreign Application Priority Data

Feb. 25, 2016 (JP) ..... 2016-034677

(51) Int. Cl.
*G03G 15/01* (2006.01)
*G03G 15/16* (2006.01)
*G03G 15/20* (2006.01)

(52) U.S. Cl.
CPC ..... *G03G 15/0131* (2013.01); *G03G 15/16* (2013.01); *G03G 15/2014* (2013.01)

(58) Field of Classification Search
CPC . G03G 15/0131; G03G 15/16; G03G 15/2014
See application file for complete search history.

(56) References Cited

U.S. PATENT DOCUMENTS 9,482,980 B1 * 11/2016 Watanabe ..... G03G 15/0131
2007/0297817 A1 * 12/2007 Bessho ..... G03G 15/0131 399/27
2015/0198914 A1 * 7/2015 Watanabe ..... G03G 15/1685 399/302
2016/0378009 A1 * 12/2016 Nakai ..... G03G 15/0131 399/223

FOREIGN PATENT DOCUMENTS

JP 2006-317633 A 11/2006

* cited by examiner

*Primary Examiner* — Rodney Bonnette
(74) *Attorney, Agent, or Firm* — Sughrue Mion, PLLC

(57) ABSTRACT

An image forming apparatus transfers a first image including a first toner not containing a metal pigment onto a specific medium having a smoothness of 112 seconds or smaller, fixes the first image for use as a base coat onto the specific medium, and transfers and fixes a second image including a second toner containing a metal pigment onto the base coat fixed onto the specific medium.

20 Claims, 14 Drawing Sheets

IMAGE FORMING APPARATUS

CROSS-REFERENCE TO RELATED APPLICATIONS

This application is based on and claims priority under 35 USC 119 from Japanese Patent Application No. 2016-034677 filed Feb. 25, 2016.

BACKGROUND

Technical Field

The present invention relates to image forming apparatuses.

SUMMARY

An image forming apparatus according to an aspect transfers a first image including a first toner not containing a metal pigment onto a specific medium having a smoothness of 112 seconds or smaller, fixes the first image for use as a base coat onto the specific medium, and transfers and fixes a second image including a second toner containing a metal pigment onto the base coat fixed onto the specific medium.

BRIEF DESCRIPTION OF THE DRAWINGS

Exemplary embodiments of the present invention will be described in detail based on the following figures, wherein:

FIG. 3A is a schematic diagram (sectional view) of a particle of a Y toner, a M toner, a C toner, and a K toner and FIG. 3B is a schematic diagram (sectional view) of a particle of a CL toner;

FIG. 5A is a sectional view of a specific medium (before an CL toner image is transferred), FIG. 5B is a sectional view of the specific medium to which a CL toner image has been transferred, FIG. 5C is a sectional view of the specific medium to which the CL toner image has been transferred and fixed, FIG. 5D is a sectional view of the specific medium to which the CL toner image has been fixed and to which a silver toner has been transferred, and FIG. 5E is a sectional view of the specific medium to which the silver toner image has been transferred and to which the silver toner has been fixed;

FIG. 6A is a plan view of the specific medium viewed from the image-formation-surface side (front surface) and FIG. 6B is a sectional view of the specific medium taken along the line VIB-VIB in FIG. 6A;

FIG. 7A is a sectional view of a specific medium (before a silver toner image is transferred thereto), FIG. 7B is a sectional view of the specific medium to which a silver toner image has been transferred, and FIG. 7C is a sectional view of the specific medium to which the silver toner image has been fixed;

FIG. 8A is a sectional view of a specific medium (before a CL toner image is transferred), FIG. 8B is a sectional view of the specific medium to which a CL toner image has been transferred, FIG. 8C is a sectional view of the specific medium to which the CL toner image has been transferred and a silver toner has been transferred, and FIG. 8D is a sectional view of the specific medium to which the CL toner and the silver toner images have been transferred and the CL toner and the silver toner have been fixed;

FIG. 9A is a sectional view of a specific medium (before a silver toner image is transferred thereto), FIG. 9B is a sectional view of the specific medium to which a silver toner image has been transferred, FIG. 9C is a sectional view of the specific medium to which the silver toner image has been transferred and fixed, FIG. 9D is a sectional view of the specific medium to which the silver toner image has been fixed and a CL toner has been transferred, and FIG. 9E is a sectional view of the specific medium to which the CL toner image has been transferred and the CL toner has been fixed;

FIG. 10A is a sectional view of a specific medium (before a silver toner image is transferred thereto), FIG. 10B is a sectional view of the specific medium to which a silver toner image has been transferred, FIG. 10C is a sectional view of the specific medium to which the silver toner image has been transferred and a CL toner has been transferred, and FIG. 10D is a sectional view of the specific medium to which the silver toner and the CL toner images have been transferred and the silver toner and the CL toner have been fixed;

FIG. 14A is a plan view of a specific medium viewed from the image-formation-surface side (front surface) and FIG. 14B is a sectional view taken along the line XIVB-XIVB.

DETAILED DESCRIPTION

Figure 1:
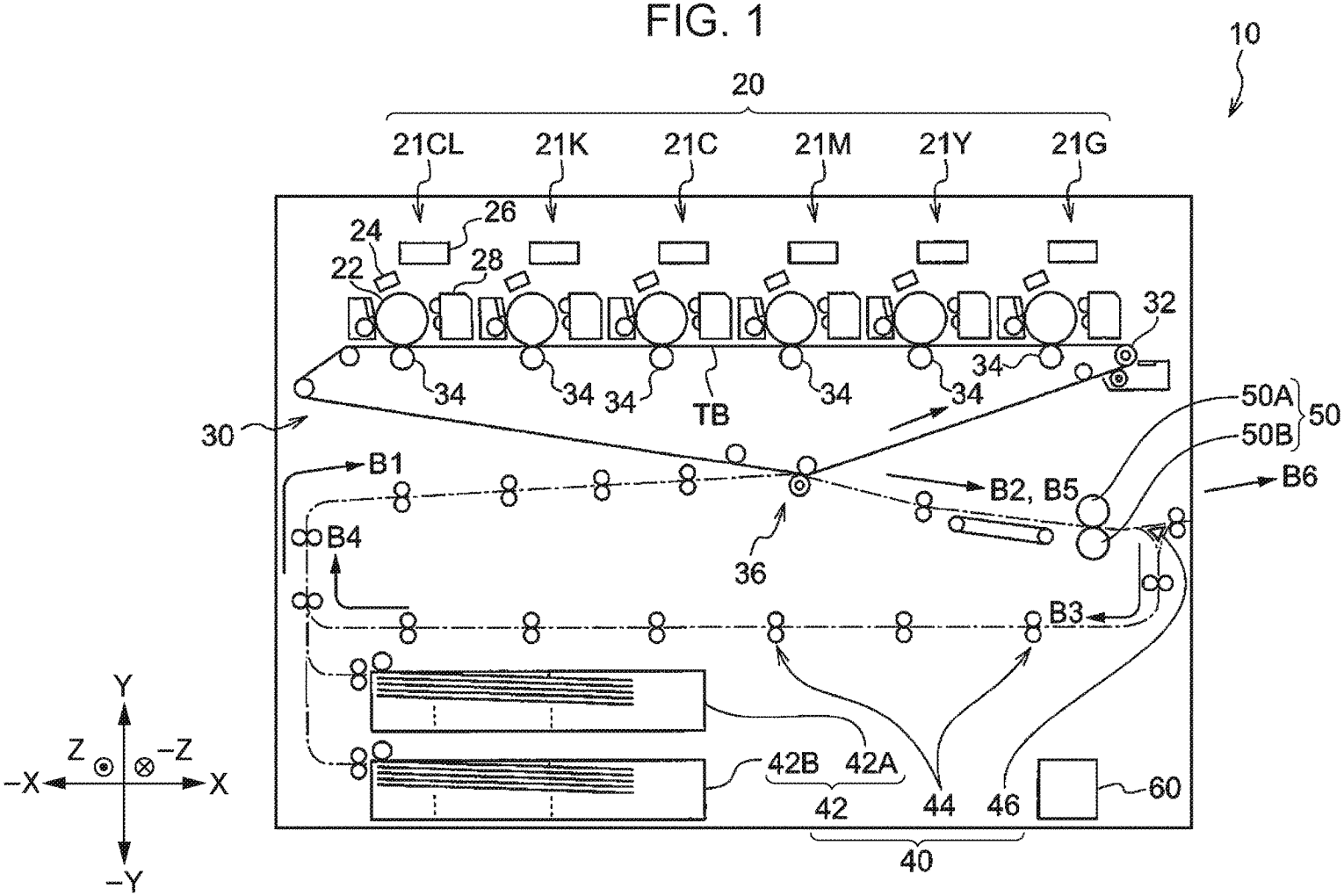
FIG. 1 is a schematic diagram of an image forming apparatus according to a first exemplary embodiment, viewed from the front.

Now, exemplary embodiments of the invention (first to fifth exemplary embodiments) are described below. Throughout the description of the exemplary embodiments, directions denoted with arrow X and arrow −X in the drawings represent an apparatus width direction. Directions denoted with arrow Y and arrow −Y in the drawings represent an apparatus height direction. Directions (directions denoted with arrow Z and arrow −Z) perpendicular to the apparatus width direction and the apparatus height direction represent an apparatus depth direction.

First Exemplary Embodiment

Referring now to the drawings, a first exemplary embodiment is described below. First, a configuration of an image forming apparatus 10 (see FIG. 1) according to this exemplary embodiment is described. Subsequently, an image forming operation of the image forming apparatus 10 according to this exemplary embodiment is described. Thereafter, operation effects of this exemplary embodiment are described.

Configuration of Image Forming Apparatus

Referring now to the drawings, a configuration of the image forming apparatus 10 is described below. Unless otherwise noted, the following description is accompanied with reference to FIG. 1. The image forming apparatus 10 is an electrophotographic apparatus including a toner-image forming portion 20, a transfer device 30, a transporting device 40, a fixing device 50, and a controller 60.

Toner-Image Forming Portion

The toner-image forming portion 20 has a function of forming toner images on each of monochrome units 21 of the toner-image forming portion 20, described below, by performing a charging process, a light exposure process, and a developing process. After the toner-image forming portion 20 is described, a toner $T_G$ (see FIG. 2), toners $T_Y$, $T_M$, $T_C$, and $T_K$ (see FIG. 3A), and a toner $T_{CL}$ (see FIG. 3B) used by the toner-image forming portion 20 are also described herein.

The toner-image forming portion 20 includes, for example, monochrome units 21G, 21Y, 21M, 21C, 21K, and 21CL, which form toner images of different colors (silver (G), yellow (Y), magenta (M), cyan (C), black (K), clear (CL)) on respective photoconductors 22, described below. The monochrome units 21G, 21Y, 21M, 21C, 21K, and 21CL are arranged in this order from the X side to −X side in the apparatus width direction. The monochrome units 21G, 21Y, 21M, 21C, 21K, and 21CL have the same configuration except that they use different toners, that is, a toner $T_G$ (see FIG. 2), toners $T_Y$, $T_M$, $T_C$, and $T_K$ (see FIG. 3A), and a toner $T_{CL}$ (see FIG. 3B). In the following description and the drawings, unless the monochrome units 21G, 21Y, 21M, 21C, 21K, and 21CL and their components need to be distinguished from one another, letters (G, Y, M, C, K, and CL) suffixed to the reference symbols of the monochrome units 21G, 21Y, 21M, 21C, 21K, and 21CL and the toners $T_G$, $T_Y$, $T_M$, $T_C$, $T_K$, and $T_{CL}$ are omitted in the description.

Each monochrome unit 21 includes a cylindrical photoconductor 22, a charging device 24, an exposure device 26, and a development device 28. The charging device 24 charges the photoconductor 22 with electricity. The exposure device 26 exposes the photoconductor 22 to light (to form a latent image on the photoconductor 22). The development device 28 develops a toner image. In the drawings, the reference symbols of components of the monochrome units 21 other than the monochrome unit 21CL are omitted.

Description of Toners

Now, toners $T_G$, $T_Y$, $T_M$, $T_C$, $T_K$, and $T_{CL}$ are described.

Toner $T_G$

Figure 2:
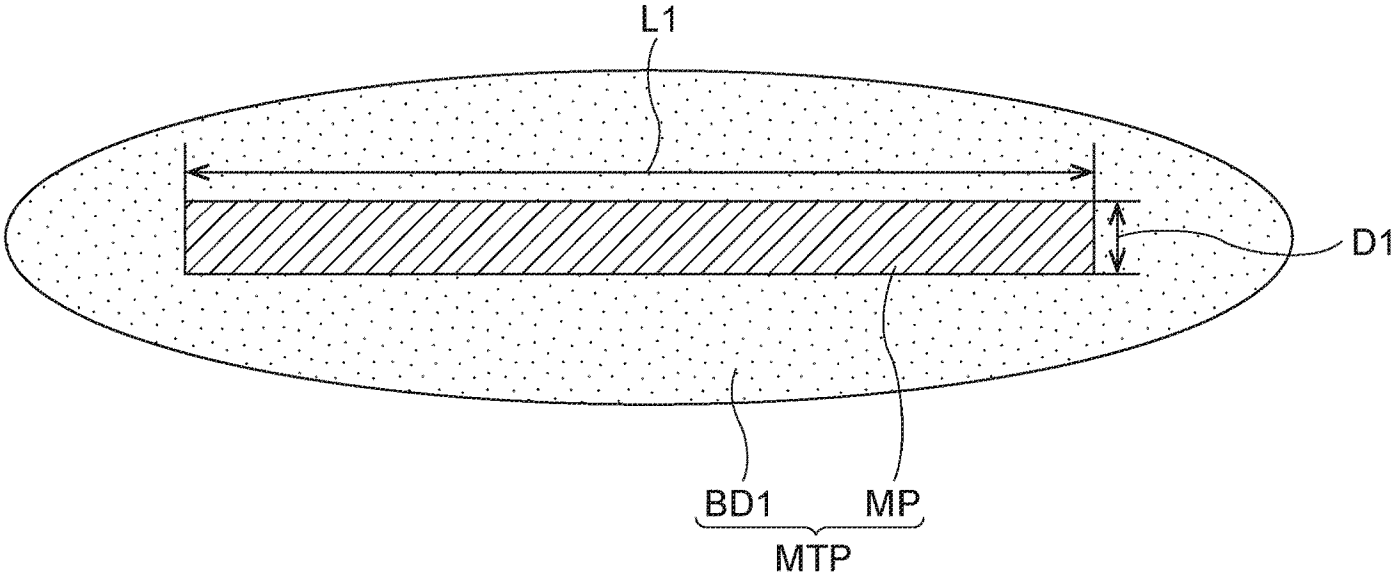
FIG. 2 is a schematic diagram (sectional view) of a silver toner particle used in the image forming apparatus according to the first exemplary embodiment.

When toner particles constituting the toner $T_G$ are designated as toner particles MTP, each toner particle MTP contains a metal pigment piece MP and a binder BD1, as illustrated in FIG. 2. Specifically, the toner $T_G$ (or toner particle MTP constituting the toner $T_G$) contains metal pigment pieces. Here, the toner $T_G$ is an example of a second toner. The binder BD1 covers each metal pigment piece MP. Each metal pigment piece MP according to this exemplary embodiment has, for example, a flat shape. Specifically, the metal pigment piece MP has, for example, a long-axis length L within a range of, for example, from 5 μm to 12 μm, and a thickness D within a range of, for example, from 0.01 μm to 0.5 μm. Here, the long-axis length L represents a length of a longest portion of the metal pigment piece MP when the metal pigment piece MP is viewed from a direction perpendicular to the thickness direction of the metal pigment piece MP. The toner particle MTP according to this exemplary embodiment has a flat shape as an example.

Toners $T_Y$, $T_M$, $T_C$, and $T_K$

Figure 3A:
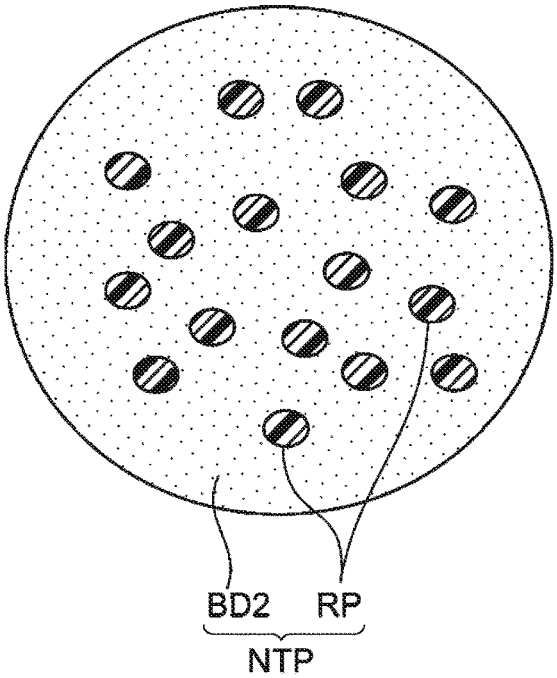
FIGS. 3A and 3B are diagrams of particles of toners other than a silver toner used in the image forming apparatus according to the first exemplary embodiment, where

When the toner particles constituting the toners $T_Y$, $T_M$, $T_C$, and $T_K$ are designated as toner particles NTP, each toner particle NTP contains, for example, resin pigment pieces RP and a binder BD2, as illustrated in FIG. 3A. Specifically, the toners $T_Y$, $T_M$, $T_C$, and $T_K$ (or the toner particles NTP constituting the toners $T_Y$, $T_M$, $T_C$, and $T_K$) do not contain a metal pigment. Each resin pigment piece RP according to this exemplary embodiment is non-flat. Specifically, in each toner particle NTP according to this exemplary embodiment, each resin pigment RP has a long-axis length/thickness ratio of, for example, smaller than 10 and the toner particle NTP has a long-axis length/thickness ratio of, for example, smaller than 2.3. The toner particle NTP according to this exemplary embodiment has, for example, a roundness of 0.90 or greater when projected on a plane. Specifically, the toner particle NTP according to this exemplary embodiment has, for example, a non-flat shape. Here, the resin pigment pieces RP contained in the respective toners $T_Y$, $T_M$, $T_C$, and $T_K$ have different colors.

Toner $T_{CL}$

Figure 3B:
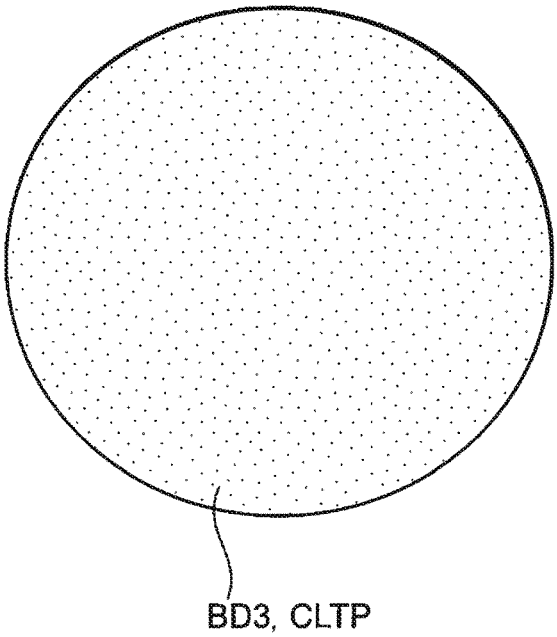

When the toner particles constituting the toner $T_{CL}$ are designated as toner particles CLTP, each toner particle CLTP contains, for example, a binder BD3, as illustrated in FIG. 3B. Specifically, the toner $T_{CL}$ (or the toner particle CLTP constituting the toner $T_{CL}$) does not contain a metal pigment. Here, the toner $T_{CL}$ is an example of a first toner. The toner particle CLTP according to this exemplary embodiment has, for example, a non-flat shape.

Transfer Device

Figure 5A:
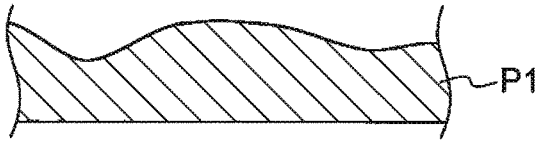
FIGS. 5A to 5E illustrate an operation of forming an image including a silver toner on a specific medium according to the first exemplary embodiment, where
Figure 5B:
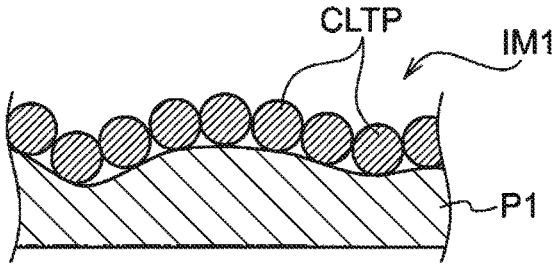
Figure 5C:
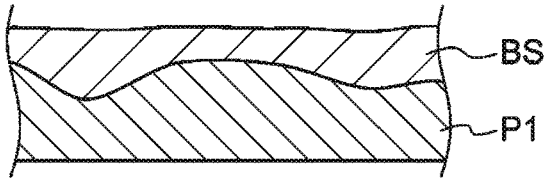
Figure 5D:
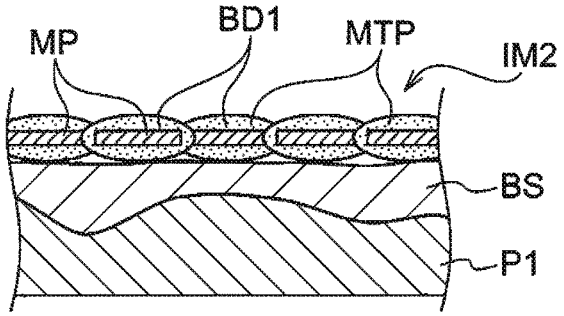

The transfer device 30 has a function of first-transferring toner images of respective colors formed on the photoconductors 22 of the monochrome units 21 onto a belt TB, described below, and second-transferring the toner images onto a medium P transported by the transporting device 40. The transfer device 30 includes a belt TB, a driving roller 32, multiple first transfer rollers 34, and a second transfer unit 36. The belt TB is an endless belt and is wound around the driving roller 32 to rotate in the direction of arrow A. Each first transfer roller 34 forms a nip at a portion of the belt TB by nipping the portion of the belt TB together with the photoconductor 22 of the corresponding monochrome unit 21 and first-transfers the toner image of the corresponding color formed on the photoconductor 22 onto the belt TB. The second transfer unit 36 forms a nip at a portion of the belt TB by nipping the belt TB and second-transfers the first-transferred toner image to a medium P that has been transported to the nip by the transporting device 40. In the following description, among toner images of various colors that have been first-transferred by the first transfer rollers 34, the toner image formed with the toner $T_{CL}$ is designated as a first image IM1 (see FIG. 5B) and the toner image formed with the toner $T_G$ is designated as a second image IM2 (see FIG. 5D).

Transporting Device

The transporting device 40 has a function of transporting a medium P. The transporting device 40 includes a container unit 42, multiple transport rollers 44, and a switching device 46.

The container unit 42 includes a first container 42A and a second container 42B, which are capable of separately accommodating different types of medium P. In this exemplary embodiment, the first container 42A accommodates media P1 and the second container 42B accommodates media P2. The difference between the media P1 and the media P2 is described below. In the following description, unless the media P1 and the media P2 need not to be particularly distinguished from each other, they are collectively referred to as media P. The information that the containers 42A and 42B respectively accommodate the media P1 and the media P2 is stored in a storage device (not illustrated) included in the controller 60 as a result of, for example, a user inputting the information through an interface (not illustrated) of the image forming apparatus 10.

The multiple transport rollers 44 feed media P accommodated in the containers 42A and 42B to a transport path (dot-dash line in the drawing) and transport the media P along the transport path. The directions of arrows B1, B2, B3, B4, B5, and B6 in the drawings denote the directions in which the transporting device 40 transports the media P. For example, in a special mode, described below, the multiple transport rollers 44 transport the media P fed from the container unit 42 in this order. Specifically, the multiple transport rollers 44 firstly transport a medium P in the direction of arrow B1 from the container unit 42 to a second transfer unit 36. The multiple transport rollers 44 then transport the medium P in the direction of arrow B2 from the second transfer unit 36 to the fixing device 50. The multiple transport rollers 44 then transport the medium P in the directions of arrows B3 and B4 from the fixing device 50 back to the second transfer unit 36 again. Thereafter, the multiple transport rollers 44 transport the medium P in the direction of arrow B5 from the second transfer unit 36 to the fixing device 50 and then transport the medium P in the direction of arrow B6 to eject the medium P out of the image forming apparatus 10. Here, the speed at which the transporting device 40 transports a medium P is determined to be constant except when the medium P is fed from the container unit 42.

Description on Medium

As described above, the first container 42A accommodates media P1 and the second container 42B accommodates media P2. Here, the media P1 are media having a smoothness of 112 seconds or smaller (for example, a J sheet manufactured by Fuji Xerox Co., Ltd.). The media P1 here are an example of specific media. The media P2 are media having a smoothness of greater than 112 seconds. The unevenness (property of being not smooth or roughness) of the surface of a medium P is said to increase with decreasing smoothness of the medium P. Specifically, in this exemplary embodiment, the media P1 have a higher surface roughness than the surface roughness of the media P2. The smoothness of the media P1 and the media P2 is calculated in accordance with JIS 8155 (Paper and board-Determination of smoothness-Oken method).

Fixing Device

The fixing device 50 heats and presses a medium P that has been subjected to a second transfer by the transfer device 30 and transported thereto by the transporting device 40 to fix the toner images to the medium P. The fixing device 50 includes a heating portion 50A and a pressing portion 50B. Each of the heating portion 50A and the pressing portion 50B according to this exemplary embodiment includes, for example, a roller. The heating portion 50A and the pressing portion 50B form a nip as a result of coming into contact with each other so that the toner image is fixed to the medium P that passes through the nip.

Controller

The controller 60 has a function of controlling components other than the controller 60 constituting the image forming apparatus 10 (hereinafter these components are referred to as the components excluding the controller 60). The function of the controller 60 is described in the description of the image forming operation.

The above is the description of the configuration of the image forming apparatus 10 according to this exemplary embodiment.

Image Forming Operation

Referring now to FIGS. 4, 5A to 5E, and 6A and 6B, the image forming operation is described below. The image forming operation according to this exemplary embodiment starts with a determination of whether the components excluding the controller 60 are to be operated in a normal mode or a special mode, described below, on the basis of image data that the controller 60 has received from an external device (not illustrated) (see FIG. 4). The controller 60 then operates the components excluding the controller 60 to perform the image forming operation in the determined mode. In the following description, an algorithm used for determining the above-described mode is described first. Then, the image forming operation performed by the components excluding the controller 60 is described. Image data include data of types of medium P used for the image forming operation and toner images that are to be fixed to each medium P.

Algorithm Used for Determining Mode

Figure 4:
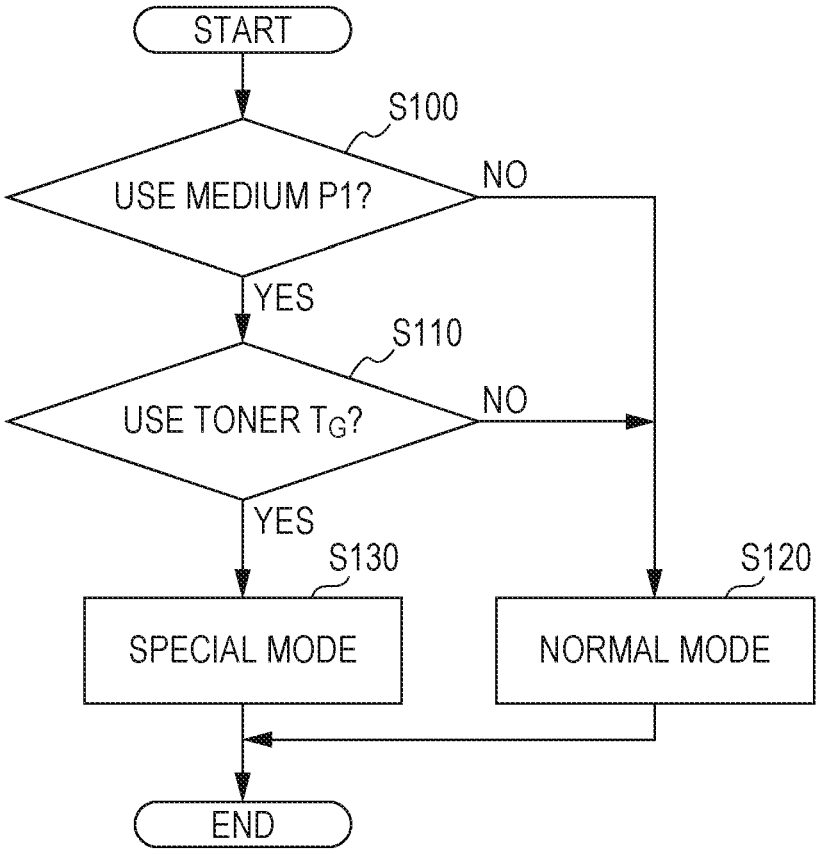
FIG. 4 is a flowchart of a mode selection algorithm that a controller uses at a start of an image forming operation according to the first exemplary embodiment.

As illustrated in FIG. 4, when the controller 60 receives image data and starts the image forming operation, the controller 60 determines in a determination step 100 (S100 in the drawing) whether the medium P that is to be used is the medium P1. When the controller 60 makes a positive determination in the determination step 100, the controller 60 proceeds to a determination of a determination step 110 (S110 in the drawing). On the other hand, when the controller 60 makes a negative determination in the determination step 100, the controller 60 operates the components excluding the controller 60 in accordance with a step 120 (S120 in the drawing) and causes the components excluding the controller 60 to perform an image forming operation in a normal mode, described below.

When the controller 60 makes a positive determination in the determination step 100 and proceeds to the determination step 110, the controller 60 determines whether the toner T that is to be used includes a toner $T_G$, that is, whether the toner $T_G$ is to be used. When the controller 60 makes a positive determination in the determination step 110, the controller 60 operates the components excluding the controller 60 in accordance with a step 130 (S130 in the drawing) and causes the components excluding the controller 60 to perform an image forming operation in a special mode, described below. On the other hand, when the controller 60 makes a negative determination in the determination step 110, the controller 60 operates the components excluding the controller 60 in accordance with the step 120 so that the components excluding the controller 60 perform an image forming operation in the normal mode. When the controller 60 finishes determining the mode in which the components excluding the controller 60 performs the image forming operation, the mode determination is complete.

The above is the description of the algorithm used for determining the mode.

Image Forming Operation Performed by Components Excluding Controller 60

Subsequently, an image forming operation performed by the components excluding the controller 60 is described. The normal mode is described first and then the special mode is described. Unless otherwise noted, the image forming operation is described with reference to FIG. 1.

Normal Mode

The controller 60 that has determined so that the components excluding the controller 60 perform an image forming operation in the normal mode operates the components excluding the controller 60 so that the components excluding the controller 60 perform the image forming operation. The operation is specifically described below.

First, the controller 60 causes the monochrome units 21 to form toner images of different colors (a toner image of a single color in the case of a monochrome image) on the corresponding photoconductors 22 on the basis of the image data. Subsequently, the controller 60 causes the transfer device 30 to first-transfer the toner images of different colors on the photoconductors 22 to the belt TB. The toner images of different colors that have been first-transferred to the belt TB are rotated toward the second transfer unit 36 together with the belt TB. The controller 60 then causes the transporting device 40 to transport a medium P accommodated in the container unit 42 in the direction of arrow B1 to the second transfer unit 36. Here, the controller 60 causes the transporting device 40 to transport the medium P such that the toner images of different colors on the belt TB arrive at the second transfer unit 36 at the same time as the medium P arrives at the second transfer unit 36. Subsequently, the controller 60 causes the second transfer unit 36 to second-transfer the toner images of different colors on the belt TB onto the medium P. The controller 60 then causes the transporting device 40 to transport the medium P on which the toner images have been second-transferred in the direction of arrow B2 to the fixing device 50. Thereafter, the controller 60 causes the fixing device 50 to fix the toner images that have been second-transferred to the medium P onto the medium P (to form images on the medium P). The controller 60 then causes the transporting device 40 to transport the medium P on which the images have been formed in the direction of arrow B6. Then, the medium P2 on which the images have been formed is transported by the transporting device 40 in the direction of arrow B6 and ejected out of the image forming apparatus 10. Thus, the image forming operation in the normal mode is complete.

The above is the description of the image forming operation in the normal mode.

Special Mode

The controller 60 that has determined so that the components excluding the controller 60 perform an image forming operation in the special mode operates the components excluding the controller 60 so that the components excluding the controller 60 perform the image forming operation. The following describes the case, for example, where an image (see FIGS. 6A and 6B) of silver "ABC" is formed on a medium P1.

First, the controller 60 causes the monochrome unit 21CL to form a toner image of a clear color (colorless toner image), that is, a first image IM1 on the photoconductor 22 on the basis of the image data. The first image IM1 has the same size and the same shape as a silver toner image that is to be formed later on the photoconductor 22 by the monochrome unit 21G, that is, a second image IM2. Subsequently, the controller 60 causes the transfer device 30 to first-transfer the first image IM1 on the photoconductor 22 of the monochrome unit 21CL to the belt TB. The first image IM1 that has been first-transferred to the belt TB is rotated toward the second transfer unit 36 together with the belt TB. The controller 60 causes the transporting device 40 to transport a medium P1 accommodated in the first container 42A in the direction of arrow B1 to the second transfer unit 36. Thereafter, the controller 60 causes the second transfer unit 36 to second-transfer the first image IM1 on the belt TB to the medium P1 (see FIG. 5B). The controller 60 then causes the transporting device 40 to transport the medium P1 to which the first image IM1 has been second-transferred in the direction of arrow B2 toward the fixing device 50. The controller 60 then causes the fixing device 50 to fix the first image IM1 that has been second-transferred to the medium P1 onto the medium P1 (see FIG. 5C). In this case, the controller 60 fixes the first image IM1 for use as a base coat BS of the second image IM2, which is to be formed later. The medium P1 to which the first image IM1 has been fixed (medium P1 on which the base coat BS has been formed) has a smoothness higher than the smoothness of a bare medium P1 (fixing the first image IM1 to the medium P1 enhances the smoothness of the surface of the medium P1).

Subsequently, the controller 60 causes the multiple transport rollers 44 and the switching device 46 to transport the medium P1 to which the first image IM1 has been fixed in the direction of arrow B3. The controller 60 also causes the monochrome unit 21G to form a second image IM2 on the photoconductor 22 on the basis of the image data. Then, the controller 60 causes the transfer device 30 to first-transfer the second image IM2 on the photoconductor 22 of the monochrome unit 21G to the belt TB. The controller 60 then causes the second image IM2 together with the belt TB to rotate toward the second transfer unit 36. The controller 60 then causes the transporting device 40 to transport the medium P1 to which the first image IM1 has been fixed in the direction of arrow B4 to the second transfer unit 36. The controller 60 then causes the second transfer unit 36 to second-transfer the first image IM1 on the belt TB to the medium P1 (see FIG. 5B). Thereafter, the controller 60 causes the transporting device 40 to transport the first image IM1 that has been second-transferred to the medium P1 toward the fixing device 50 in the direction of arrow B2. The controller 60 then causes the fixing device 50 to fix the first image IM1 to the medium P1.

The controller 60 then causes the transporting device 40 to transport the medium P1 to which the first image IM1 has been fixed in the direction of arrow B4 such that the first image IM1 on the belt TB arrives at the second transfer unit 36 at the same time as the medium P1 to which the first image IM1 has been fixed arrives at the second transfer unit 36. Subsequently, the controller 60 causes the second transfer unit 36 to second-transfer the second image IM2 onto the medium P1 to which the first image IM1 has been fixed such that the second image IM2 on the belt TB is superposed on the first image IM1 fixed to the medium P1 (see FIG. 5D). The controller 60 then causes the transporting device 40 to transport the medium P to which the second image IM2 has been second-transferred so as to be superposed on the fixed first image IM1 in the direction of arrow B5 to the fixing device 50. The controller 60 then causes the fixing device 50 to fix the second image IM2 that has been second-transferred to the medium P1 onto the medium P1 at a fixing temperature equivalent to the fixing temperature at which the first image IM1 is fixed to the medium P1 (form an image IMG on the medium P1) (see FIG. 5E). Then, the controller 60 causes the transporting device 40 to transport the medium P1 on which the image IMG has been formed (see FIGS. 6A and 6B) in the direction of arrow B6. The medium P1 on which the image IMG has been formed is transported by the transporting device 40 in the direction of arrow B6 and ejected out of the image forming apparatus 10. Thus, the image forming operation in the special mode is complete.

Figure 5E:
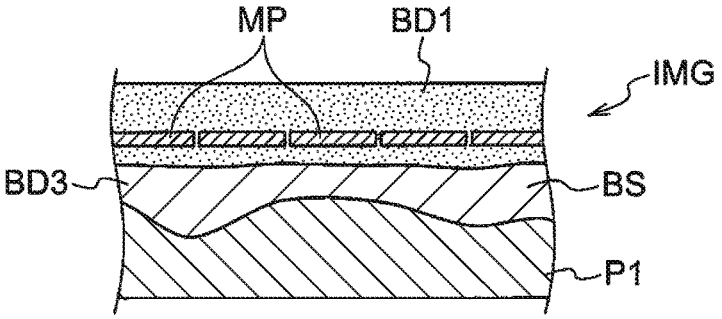
Figure 6B:
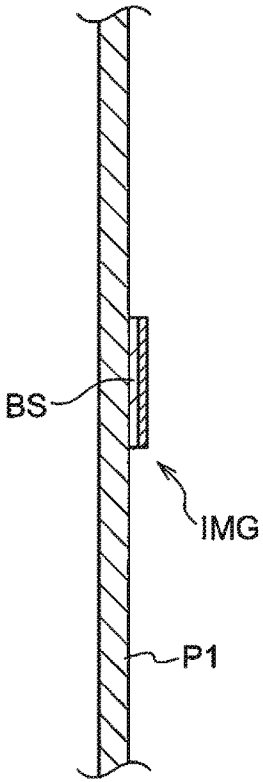
FIGS. 6A and 6B illustrate a specific medium on which an image including a silver toner is formed according to the first exemplary embodiment, where
Figure 6A:
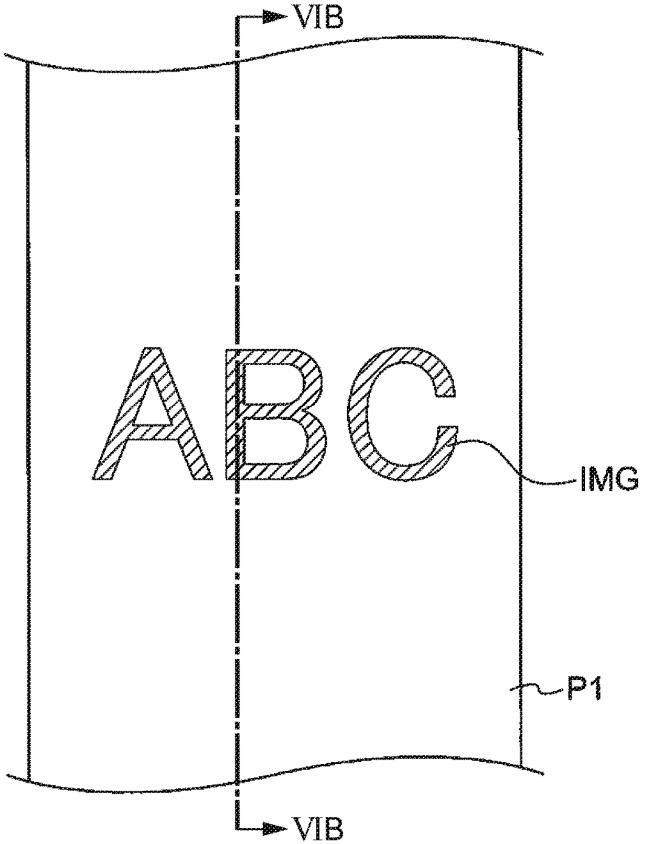

As described above, in the case of the image forming apparatus 10 operated in the special mode, the controller 60 operates the components excluding the controller 60 so as to transfer and fix the second image IM2 on the belt TB onto the colorless base coat BS fixed onto the medium P1 (see FIG. 5E and FIG. 6B).

The above is the description of the image forming operation in the special mode.

Operation Effects

Now, operation effects of this exemplary embodiment are described.

First Operation Effect

A first operation effect is an operation effect obtained, when an image IMG including the second image IM2 is formed on the medium P1, by fixing the first image IM1 onto the medium P1 for use as the base coat BS and transferring and fixing the second image IM2 onto the base coat BS. The first operation effect is described on the basis of evaluation results obtained by conducting an evaluation test, described below, in which this exemplary embodiment and comparative examples (first to fourth comparative examples), described below, are compared with one another. When components and the like the same as those used in this exemplary embodiment are used in each of the comparative examples, those components and the like are denoted with the same reference symbols although they may be unillustrated.

DESCRIPTION OF CONFIGURATIONS OF COMPARATIVE EXAMPLES

Referring now to the drawings, comparative examples are described below.

First Comparative Example

Figure 7A:
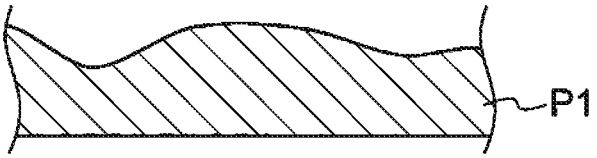
FIGS. 7A to 7C illustrate an operation of forming an image including a silver toner on a specific medium according to a first comparative example, where
Figure 7B:
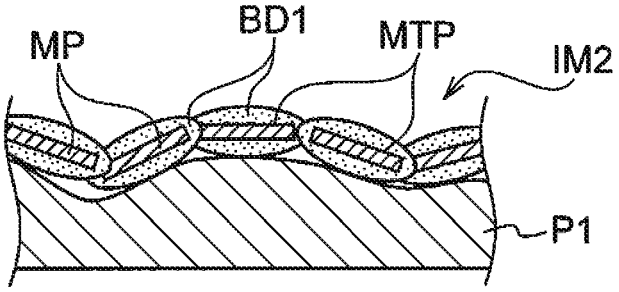
Figure 7C:
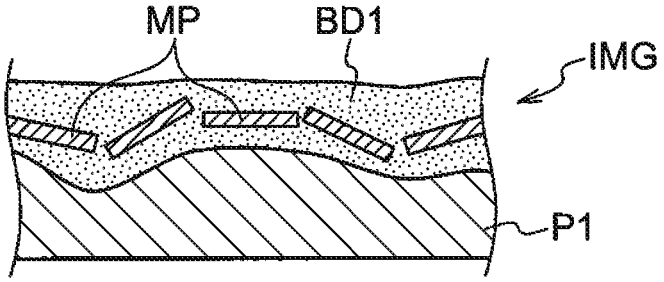

In a first comparative example, the image forming operation is performed in a normal mode, so called in this exemplary embodiment, when a medium P that is to be used is a medium P1 and a toner T that is to be used includes a toner $T_G$ (see FIGS. 7A, 7B, and 7C). The first comparative example is similar to this exemplary embodiment except for the above point.

Second Comparative Example

In a second comparative example, the image forming operation is performed in a first modification mode modeled after a special mode, so called in this exemplary embodiment, when a medium P that is to be used is a medium P1 and a toner T that is to be used includes a toner $T_G$ (see FIGS. 8A, 8B, 8C, and 8D). Here, the first modification mode is a mode in which the first image IM1 is transferred onto the medium P1 without being fixed thereto, the second image IM2 is transferred onto the first image IM1, and then the first image IM1 and the second image IM2 are fixed onto the medium P1 (see FIG. 8C). Specifically, in the second comparative example, the second image IM2 is transferred onto the first image IM1 before the first image IM1 is fixed for use as the base coat BS. The second comparative example is similar to this exemplary embodiment except for the above point.

Third Comparative Example

In a third comparative example, the image forming operation is performed in a second modification mode modeled after the special mode, so called in this exemplary embodiment, when a medium P that is to be used is a medium P1 and a toner T that is to be used includes a toner $T_G$ (see FIGS. 9A, 9B, 9C, 9D, and 9E). Here, the second modification mode is a mode in which a second image IM2 is firstly transferred and fixed to the medium P1 (see FIGS. 9B and 9C), and then the first image IM1 is transferred and fixed onto the second image IM2 fixed onto the medium P1 (see FIGS. 9D and 9E). The third comparative example is similar to this exemplary embodiment except for the above point.

Fourth Comparative Example

In a fourth comparative example, the image forming operation is performed in a third modification mode modeled after the special mode, so called in this exemplary embodiment, when a medium P that is to be used is a medium P1 and a toner T that is to be used includes a toner $T_G$ (see FIGS. 10A, 10B, 10C, and 10D). Here, the third modification mode is a mode in which the second image IM2 is firstly transferred onto the medium P1 without being fixed thereto (see FIG. 10A), and then the first image IM1 is transferred and fixed onto the second image IM2 that has been transferred onto the medium P1 (see FIGS. 10C and 10D). The fourth comparative example is similar to this exemplary embodiment except for the above point.

Description of Evaluation Test

The evaluation test is described now. In the evaluation test, each of the image forming apparatus 10 according to this exemplary embodiment and image forming apparatuses of the comparative examples (first to fourth comparative examples) forms a sample of a silver ABC image (see FIGS. 6A and 6B) on a medium P1. Then, the metallic luster (Flop Index or F. I.) was measured at the image portion of each sample. Here, the metallic luster was measured in accordance with ASTM E2194.

Results of Evaluation Test and Consideration

Figure 11:
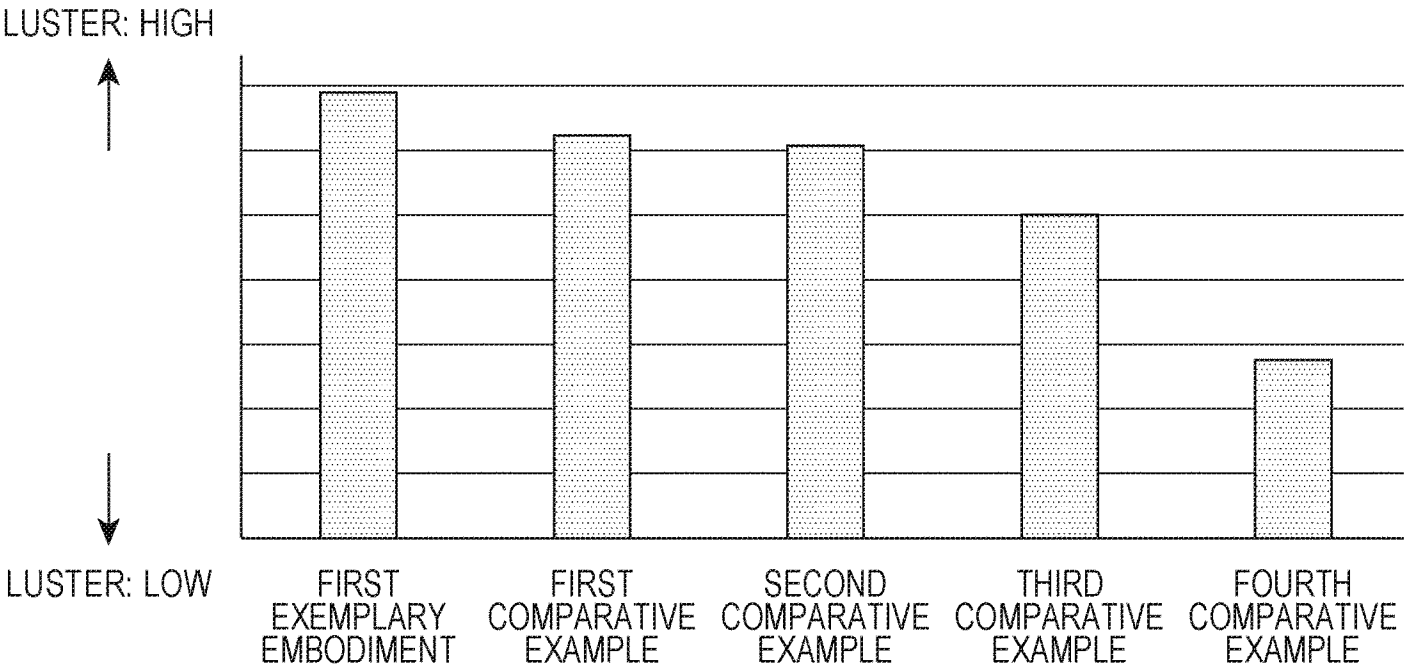
FIG. 11 is a graph illustrating a luster of an image including a silver toner formed on a specific medium using the image forming apparatus according to the first exemplary embodiment and a luster of an image including a silver toner formed on a specific medium using an image forming apparatus according to each of the first to fourth comparative examples.

The graph of FIG. 11 shows the measurement results of the luster of the samples formed by the image forming apparatus 10 according to this exemplary embodiment and the image forming apparatuses of the comparative examples (first to fourth comparative examples). According to the graph of FIG. 11, the metallic luster of the sample formed by this exemplary embodiment is higher than the metallic luster of the samples formed by the comparative examples.

In consideration of the results of the evaluation test, the following phenomenon has conceivably occurred in this exemplary embodiment and each comparative example.

Figure 9A:
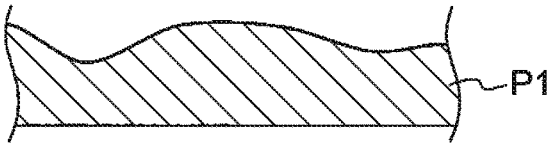
FIGS. 9A to 9E illustrate an operation of forming an image including a silver toner on a specific medium according to a third comparative example, where
Figure 9B:
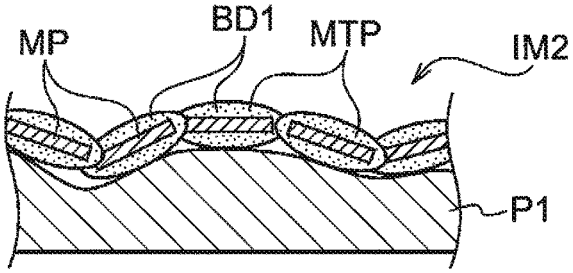
Figure 9C:
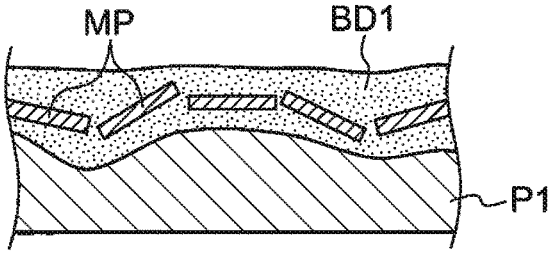
Figure 9D:
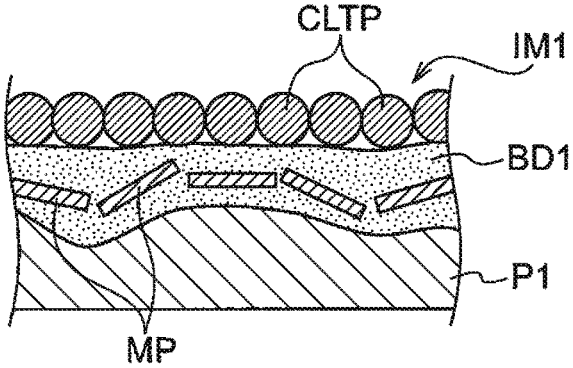
Figure 9E:
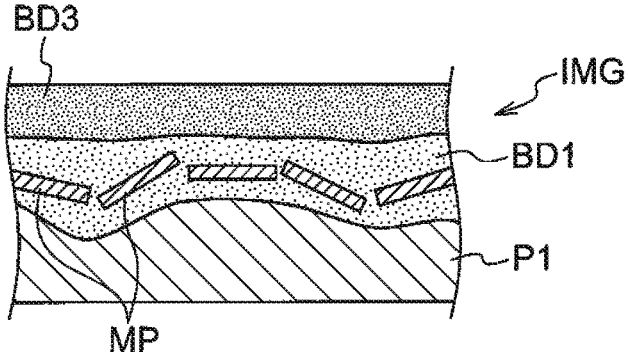
Figure 10A:
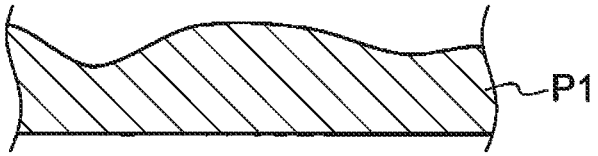
FIGS. 10A to 10D illustrate an operation of forming an image including a silver toner on a specific medium according to a fourth comparative example, where
Figure 10B:
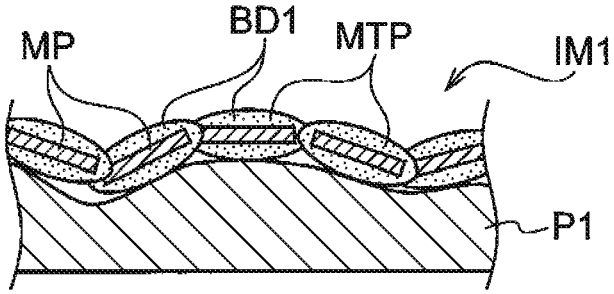
Figure 10C:
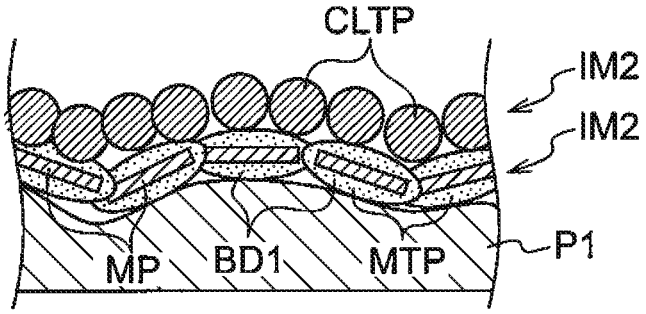
Figure 10D:
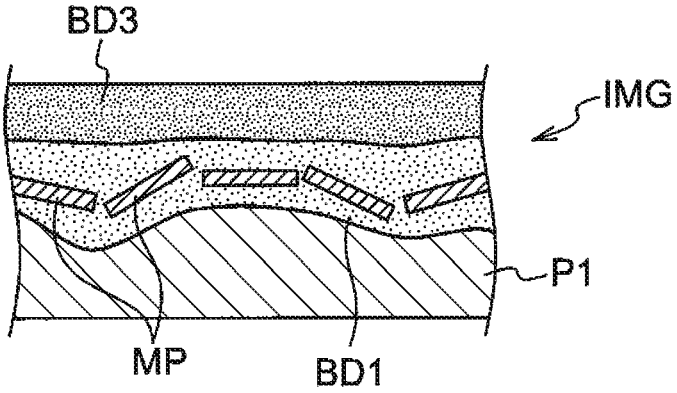

Specifically, in the cases of the first, third, and fourth comparative examples, the second image IM2 is directly fixed to the medium P1. Thus, the toner $T_G$ is likely to be so oriented as to follow the shape of the surface of the bare medium P1 when being fixed to the medium P1 (when pressed and heated by the fixing device 50). Thus, the image IMG has been conceivably formed in the state where the axes of the metal pigment pieces MP are oriented in various directions as illustrated in FIG. 7C, FIG. 9E, and FIG. 10D.

Figure 8A:
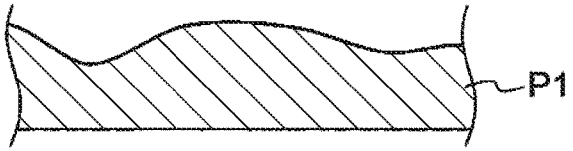
FIGS. 8A to 8D illustrate an operation of forming an image including a silver toner on a specific medium according to a second comparative example, where
Figure 8B:
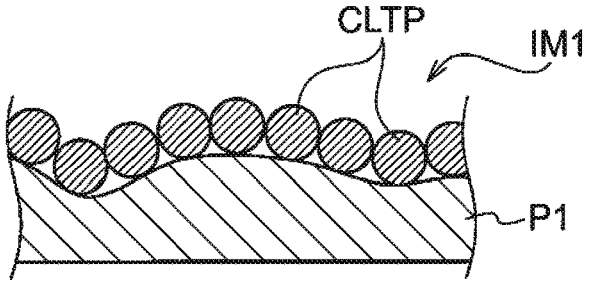
Figure 8C:
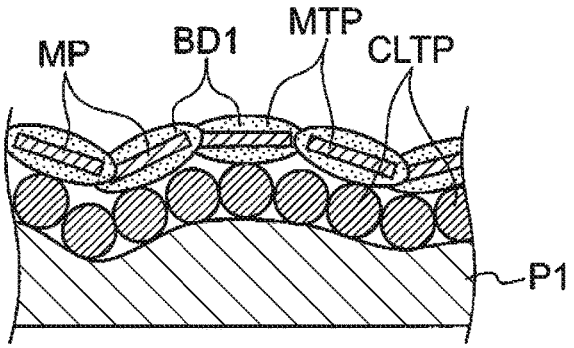
Figure 8D:
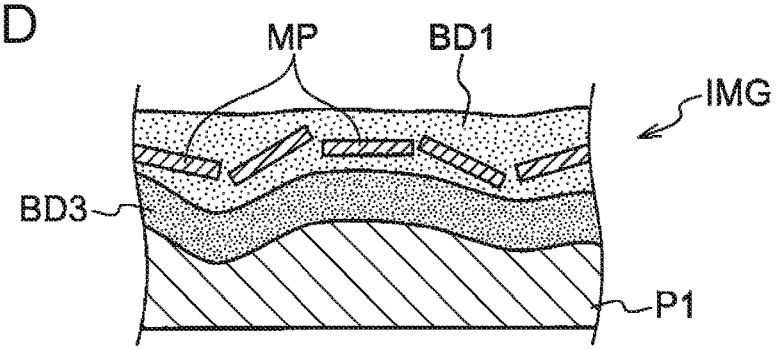

In the case of the second comparative example, the second image IM2 is transferred onto the first image IM1 that has not been fixed to the medium P1. Thus, while being fixed, the toner $T_G$ is likely to move easily together with the toner $T_{CL}$. Thus, the image IMG has been conceivably formed in the state where the axes of the metal pigment pieces MP are oriented in various directions as illustrated in FIG. 8D.

On the other hand, in this exemplary embodiment, unlike the cases of the comparative examples, the first image IM1 is fixed to the medium P1 for use as the base coat BS (see FIG. 5C) and the second image IM2 is transferred and fixed onto the base coat BS (see FIGS. 5D and 5E) to form an image IMG including the second image IM2 on the medium P1. The surface of the medium P1 on which the base coat BS is formed thus becomes smoother than the surface of the bare medium P1. Thus, in this exemplary embodiment, flat metal pigment pieces MP contained in the second image are fixed while being oriented so as to follow the shape of the surface smoother than the bare medium P1 while being fixed. Thus, in this exemplary embodiment, the image IMG has been conceivably formed while the axes of the metal pigment pieces MP are oriented so as to follow the smooth surface, as illustrated in FIG. 5E.

The image forming apparatus 10 according to this exemplary embodiment is thus capable of forming images having a metallic luster higher than that of images formed by directly fixing to the medium P1 a toner image including a toner containing metal pigment pieces having a flat shape.

Figure 12:
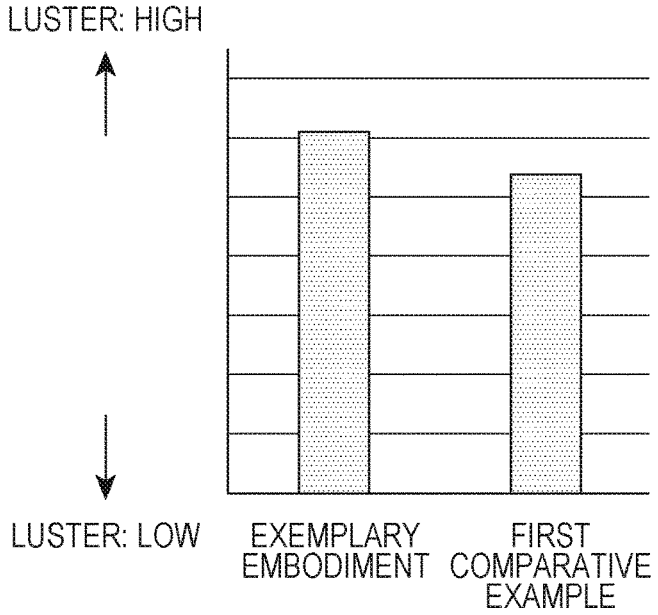
FIG. 12 is a graph illustrating a luster of an image including a silver toner formed on a different type of a specific medium using the image forming apparatus according to the first exemplary embodiment and a luster of an image including a silver toner formed on a different type of a specific medium using an image forming apparatus according to each of the first to fourth comparative examples.

The graph in FIG. 12 shows the measurement results of the luster of samples formed on a different example of the medium P1, that is, Business 80 gsm (manufactured by Fuji Xerox Co., Ltd.) by the image forming apparatus 10 according to this exemplary embodiment and the image forming apparatus of the first comparative example. Here, Business 80 gsm has a smaller smoothness than the J sheet. The graph of FIG. 12 shows that the metallic luster of the sample according to this exemplary embodiment is higher than the metallic luster of the sample according to the first comparative example.

Second Operation Effect

A second operation effect is an operation effect obtained due to the base coat BS being colorless. The second operation effect is described through a comparison between this exemplary embodiment and a fifth comparative example (not illustrated), described below. When components and the like the same as those used in this exemplary embodiment are used in the fifth comparative example, those components and the like are denoted with the same reference symbols.

In the case of the fifth comparative example, the base coat BS is colored. Thus, in the case of the fifth comparative example, the color of the medium P1 is not usable as the base color to form the image IMG. Nevertheless, the fifth comparative example has a first operation effect because, when an image IMG including the second image IM2 is formed on the medium P1, the first image IM1 is fixed to the medium P1 for use as the base coat BS and the second image IM2 is then transferred and fixed onto the base coat BS. In other words, the fifth comparative example belongs to the technical scope of the present invention.

The image forming apparatus 10 according to this exemplary embodiment is, on the other hand, capable of using the color of the medium P1 as a base color to form the image IMG.

The above is the description of the first exemplary embodiment.

Second Exemplary Embodiment

Now, an image forming apparatus according to a second exemplary embodiment (not illustrated) is described. The following describes a portion that differs between the image forming apparatus according to this exemplary embodiment and the image forming apparatus 10 according to the first exemplary embodiment (see FIG. 1). When components and the like the same as those used in the first exemplary embodiment are used in this exemplary embodiment, those components and the like are denoted with the same reference symbols although they may be unillustrated.

Portion Different from First Exemplary Embodiment

In this exemplary embodiment, the fixing temperature at which the first image IM1 is fixed in the special mode is higher than the fixing temperature at which the first image IM1 is fixed in the normal mode. This exemplary embodiment is similar to the first exemplary embodiment except for the above point.

Operation Effects

In this exemplary embodiment, the temperature at which the first image IM1 is fixed in the special mode is higher than the temperature at which the first image IM1 is fixed in the normal mode. Thus, in this exemplary embodiment, the surface of the base coat BS becomes smoother than in the case where the first image IM1 is fixed to the medium P1 in the special mode at the fixing temperature equal to the fixing temperature at which the first image IM1 is fixed in the normal mode. Thus, the image forming apparatus according to this exemplary embodiment is capable of forming images IMG having a metallic luster higher than that of images formed as a result of fixing the first image IM1 onto the medium P1 for use as the base coat BS at a fixing temperature that is lower than or equal to the fixing temperature at which only the first image IM1 is fixed to the medium P1.

Other operation effects of this exemplary embodiment are similar to those in the case of the first exemplary embodiment.

The above is the description of the second exemplary embodiment.

Third Exemplary Embodiment

Now, an image forming apparatus (not illustrated) according to a third exemplary embodiment is described. The following describes a portion that differs between the image forming apparatus according to this exemplary embodiment and the image forming apparatus 10 (see FIG. 1) according to the first exemplary embodiment. When components and the like the same as those used in the first exemplary embodiment are used in this exemplary embodiment, those components and the like are denoted with the same reference symbols although they may be unillustrated.

Portion Different from First Exemplary Embodiment

In this exemplary embodiment, the fixing speed at which the first image IM1 is fixed in the special mode is lower than the fixing speed at which the first image IM1 is fixed in the normal mode. This exemplary embodiment is similar to the first exemplary embodiment except for the above point.

Operation Effects

In this exemplary embodiment, the first image IM1 is fixed in the special mode at a speed lower than the speed at which the first image IM1 is fixed in the normal mode. Thus, in this exemplary embodiment, the surface of the base coat BS becomes smoother than in the case where the first image IM1 is fixed to the medium P1 in the special mode at the fixing speed equal to the fixing speed at which the first image IM1 is fixed to the medium P1 in the normal mode. Thus, the image forming apparatus according to this exemplary embodiment is capable of forming images IMG having a metallic luster higher than that of images formed as a result of fixing the first image IM1 onto the medium P1 for use as the base coat BS at the fixing speed higher than or equal to the fixing speed at which only the first image IM1 is fixed to the medium P1.

Other operation effects of this exemplary embodiment are similar to those in the case of the first exemplary embodiment.

The above is the description of the third exemplary embodiment.

Fourth Exemplary Embodiment

Now, an image forming apparatus according to a fourth exemplary embodiment (not illustrated) is described. The following describes a portion that differs between the image forming apparatus according to this exemplary embodiment and the image forming apparatus 10 according to the first exemplary embodiment (see FIG. 1). When components and the like the same as those used in the first exemplary embodiment are used in this exemplary embodiment, those components and the like are denoted with the same reference symbols although they may be unillustrated.

Portion Different from First Exemplary Embodiment

In this exemplary embodiment, the toner density at which the first image IM1 is formed in the special mode (amount of toner per unit area) is higher than the toner density at which the first image IM1 is formed in the normal mode. Specifically, for example, the development device 28 according to this exemplary embodiment develops the same latent image with the toner $T_{CL}$ such that the toner density at which the first image IM1 is formed in the special mode is higher than the toner density at which the first image IM1 is formed in the normal mode. This exemplary embodiment is similar to the first exemplary embodiment except for the above point.

Operation Effects

In this exemplary embodiment, the toner density at which the first image IM1 is formed in the special mode is higher than the toner density at which the first image IM1 is formed in the normal mode. Thus, in this exemplary embodiment, the surface of the base coat BS becomes smoother than in the case where the first image IM1 is fixed to the medium P1 in the special mode at a toner density the same as the toner density at which the first image IM1 is fixed to the medium P1 in the normal mode. Thus, the image forming apparatus according to this exemplary embodiment is capable of forming images having a metallic luster higher than that of images formed by fixing the first image IM1 to the medium P1 for use as the base coat at a toner density that is lower than or equal to the toner density at which only the first image is fixed to the medium P1.

Other operation effects of this exemplary embodiment are similar to those in the case of the first exemplary embodiment.

The above is the description of the fourth exemplary embodiment.

Fifth Exemplary Embodiment

Now, an image forming apparatus according to a fifth exemplary embodiment (not illustrated) is described. The following describes a portion that differs between the image forming apparatus according to this exemplary embodiment and the image forming apparatus 10 according to the first exemplary embodiment (see FIG. 1). When components and the like the same as those used in the first exemplary embodiment are used in this exemplary embodiment, those components and the like are denoted with the same reference symbols although they may be unillustrated.

Portion Different from First Exemplary Embodiment

In this exemplary embodiment, the toner-image forming portion 20 includes seven monochrome units 21. Specifically, a monochrome unit (referred to as an additional monochrome unit, below) that forms a clear toner image on the photoconductor 22 is disposed between the monochrome unit 21K and the monochrome unit 21CL in the apparatus width direction. The specific low-temperature storage elastic modulus of the clear toner T of the additional monochrome unit is smaller than the specific low-temperature storage elastic modulus of the toner $T_{CL}$ of the monochrome unit 21CL. The toner T having a higher specific storage elastic modulus melts with heat to a lesser extent (is fixed to a lesser extent). Here, in this exemplary embodiment, the clear toner T of the additional monochrome unit is an example of a first toner. The toner $T_{CL}$ of the monochrome unit 21CL is an example of a third toner.

The specific low-temperature storage elastic modulus represents a low-temperature storage elastic modulus measured at a temperature within the range of 30° C. to 50° C. The storage elastic modulus is measured using a rheometer (ARES) manufactured by TA instruments Japan Inc. Specifically, the storage elastic modulus is measured by setting a sample (toner) in a sample holder having a diameter of 8 mm and under the conditions of the temperature rise speed of 1° C./min, frequency of 1 Hz, distortion factor of 1% or smaller, and detected torque of within measurement guaranteed figures. Then, a change of the storage elastic modulus in relation to the temperature change is obtained. A normal software of a viscoelasticity measuring device is used for analysis. In the above-described storage elastic modulus, the low-temperature storage elastic modulus measured at a temperature within the range of 30° C. to 50° C. is obtained as an arithmetic mean of all the storage elastic moduli measured in one degree intervals at temperatures within the range of 30° C. to 50° C. The wording "the low-temperature storage elastic modulus is large or small" here represents that this arithmetic mean is large or small.

In this exemplary embodiment, the first image IM1 is formed in the normal mode using the toner $T_{CL}$ of the monochrome unit 21CL, whereas the first image IM1 is formed in the special mode using the clear toner T of the additional monochrome unit. This exemplary embodiment is similar to the first exemplary embodiment except for the above point.

Operation Effects

In the case of the first exemplary embodiment, the same toner $T_{CL}$ is used to form the first image IM1 in the special mode and the first image IM1 in the normal mode. In contrast, in this exemplary embodiment, the toner T fixed for use as the base coat BS to form the first image IM1 in the special mode has a specific low-temperature storage elastic modulus that is smaller than the specific low-temperature storage elastic modulus of the toner $T_{CL}$ used to form the first image IM1 in the normal mode. Thus, in this exemplary embodiment, the surface of the base coat BS becomes smoother than in the case of the first exemplary embodiment. Thus, the image forming apparatus according to this exemplary embodiment is capable of forming images having a metallic luster higher than that of images formed by forming a first image in the special mode using a toner having a specific low-temperature storage elastic modulus larger than or equal to the specific low-temperature storage elastic modulus of the toner used to form the first image in the normal mode.

Other operation effects of this exemplary embodiment are similar to those in the case of the first exemplary embodiment.

The above is the description of the fifth exemplary embodiment.

Thus far, the present invention has been described using specific exemplary embodiments as examples. The present invention, however, is not limited to the above-described exemplary embodiments. The technical scope of the present invention includes, for example, the following forms.

Each exemplary embodiment has described that the color of the toner $T_G$, which is an example of a second toner, is silver (see FIG. 2). However, the color of the second toner is not limited to silver and may be other colors as long as the second toner is a toner containing metal pigment pieces MP. For example, the second toner may have another metallic color such as gold or silvery white.

Each exemplary embodiment has described that the particles of the toner $T_G$, which is an example of the second toner, have a flat shape (see FIG. 2). However, the shape of the particles of the second toner is not limited to a flat shape as long as the metal pigment pieces MP have a flat shape. For example, the particles of the second toner may have a non-flat shape, as in the case of the shape of the toner particles MTP1 illustrated in FIG. 13.

Figure 13:
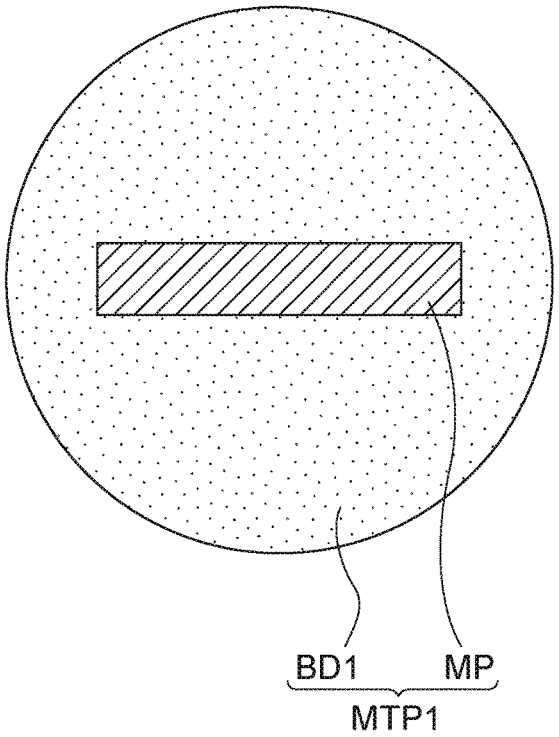
FIG. 13 is a schematic view (sectional view) of a silver toner according to a modification example used in each of the image forming apparatuses according to the first to fifth exemplary embodiments.

Each exemplary embodiment and the modification example illustrated in FIG. 13 have described that the metal pigment pieces MP contained in the second toner have a flat shape. However, the shape of the metal pigment pieces is not limited to a flat shape as long as the pigment contained in the second toner is a metal pigment. The shape of the metal pigment pieces may be a non-flat shape, such as, a spherical shape or a polygonal shape. Even in this case, images may have a metallic luster higher than that of images formed by directly fixing, to a medium P1, a toner image including a toner containing metal pigment pieces having a non-flat shape.

Each exemplary embodiment has described that the toner $T_{CL}$, which is an example of a first toner, is a clear toner. However, the first toner may be, for example, a white toner. In this case, an image IMG may be formed using white as a base color regardless of the color of the medium P1.

Figure 14B:
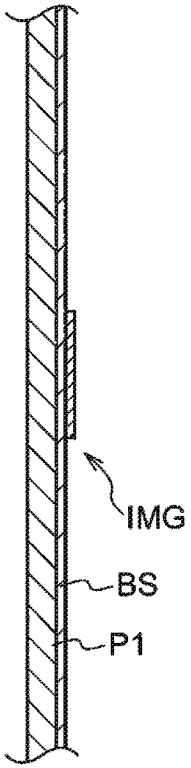
FIGS. 14A and 14B illustrate an image formation pattern according to a modification example in the case of forming an image including a silver toner on a specific medium using each of the image forming apparatuses according to the first to fifth exemplary embodiments, where
Figure 14A:
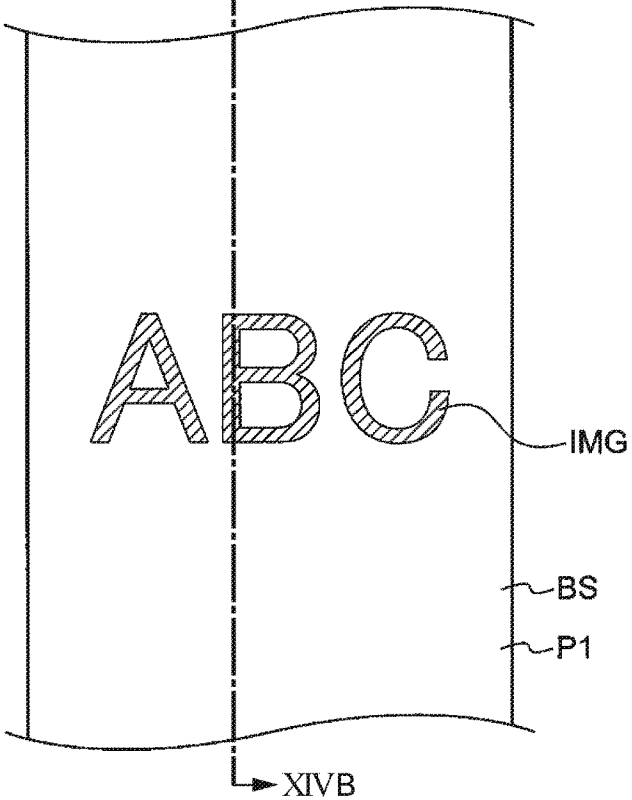

Each exemplary embodiment has described that the base coat BS is formed so as to have the same size and the same shape as the second image IM2 formed on the photoconductor 22 by the monochrome unit 21G. However, the size and the shape of the base coat BS do not have to be the same as the size and the shape of the second image IM2 as long as the entirety of the second image IM2 is formed over the base coat BS. As illustrated in, for example, FIGS. 14A and 14B, the base coat BS may extend beyond the second image IM2 (for example, extend over the entire area of the image-formation surface of the medium P1 in the case illustrated in FIGS. 14A and 14B).

Each exemplary embodiment has described that the first image IM1 is formed with the toner $T_{CL}$. However, in the case of forming an image IMG including the second image IM2 on the medium P1, the first image IM1 may be formed with a toner T having a color different from the color of the toner $T_{CL}$ as long as the first image IM1 is fixed to the medium P1 for use as the base coat BS and the second image IM2 is transferred and fixed onto the base coat BS. In the case where, for example, the color of the medium P1 is black, the first image IM1 may be formed with the toner $T_K$.

Figure 15:
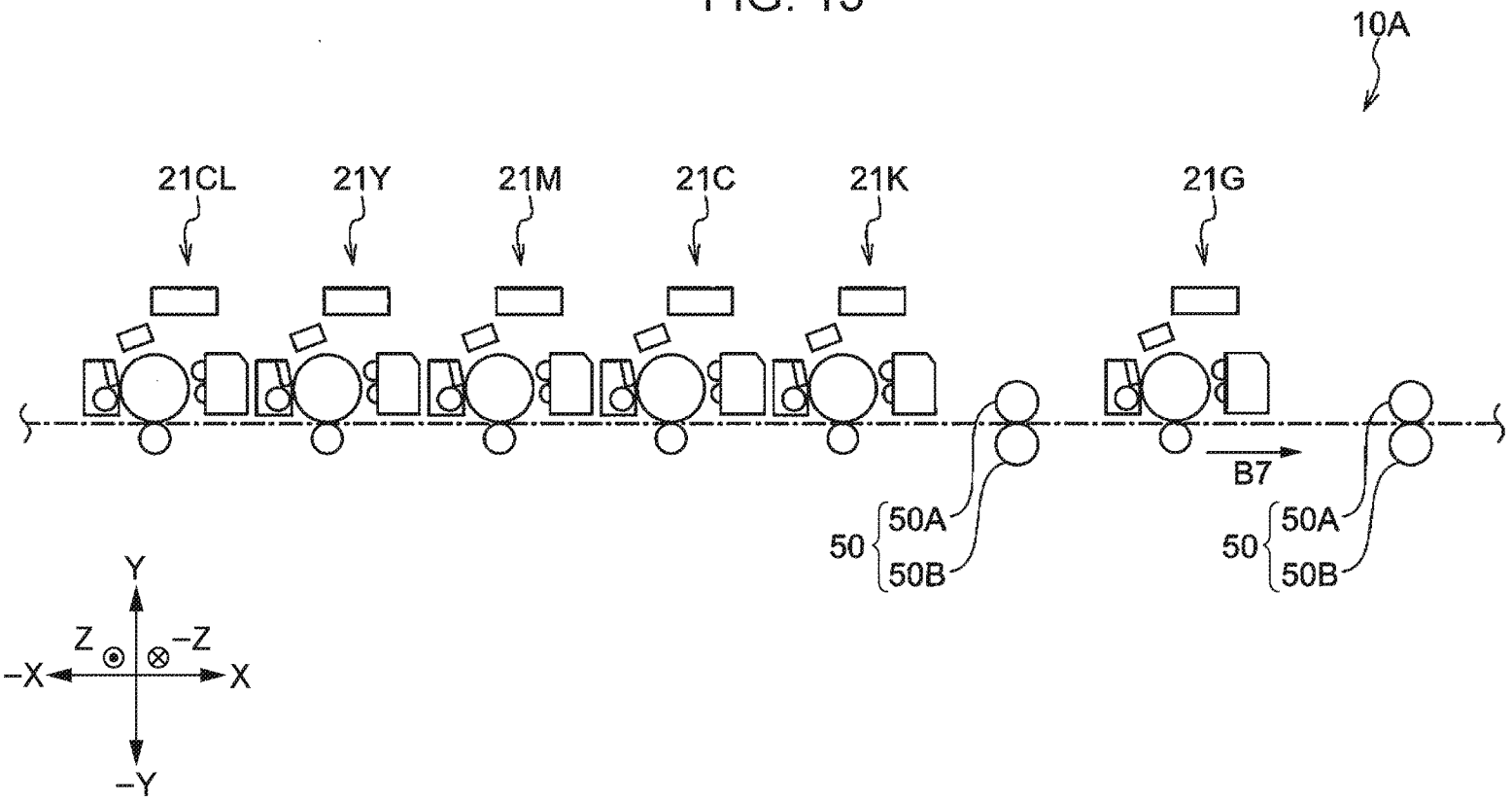
FIG. 15 is a schematic view of an image forming apparatus according to a modification example obtained by modifying the image forming apparatus according to any of the first to fifth exemplary embodiments, when the image forming apparatus according to the modification example is viewed from the front.

Each exemplary embodiment has been described using the image forming apparatus 10 illustrated in FIG. 1 as an example. However, the image forming apparatus may have a configuration different from the configuration of the image forming apparatus 10 illustrated in FIG. 1 as long as the image forming apparatus is capable of fixing the first image IM1 onto the medium P1 for use as the base coat BS and transferring and fixing the second image IM2 onto the base coat BS when forming an image IMG including the second image IM2 on the medium P1. For example, as illustrated in FIG. 15, the image forming apparatus may be a so-called tandem image forming apparatus 10A that directly transfers a toner image formed by each monochrome unit 21 onto a medium P. In the image forming apparatus 10A, monochrome units 21CL, 21Y, 21M, 21C, and 21K, a first fixing device 50, a monochrome unit 21G, and a second fixing device 50 are arranged in this order from the upstream side to the downstream side in the direction in which the medium P is transported (direction of arrow B7). Thus, after the monochrome unit 21CL forms a first image IM1, the first fixing device 50 fixes the first image IM1 for use as the base coat BS and the monochrome unit 21G transfers the second image IM2 onto the base coat BS in a superposed manner, and the second fixing device 50 fixes the second image IM2. Specifically, the image forming apparatus 10A according to the modification example forms images at a higher speed (forms images on more sheets per unit time) than the image forming apparatus according to this exemplary embodiment 10. Alternatively, other image forming apparatuses according to other modification examples include an image forming apparatus of a rotary developing intermediate transfer type, although not illustrated.

As described above, the exemplary embodiments and the modification examples are individually described. However, the technical scope of the present invention includes a form in which one or more elements other than those according to the exemplary embodiments and the modification examples are combined with any of the exemplary embodiments and the modification examples. For example, an element of the third exemplary embodiment (rendering the fixing speed at which the first image IM1 is fixed in the special mode lower than the fixing speed at which the first image IM1 is fixed in the normal mode) may be combined with the image forming apparatus according to the second exemplary embodiment. Alternatively, an element according to the fourth exemplary embodiment (rendering the toner density of the first image IM1 formed in the special mode higher than the toner density of the first image IM1 formed in the normal mode) may be combined with the image forming apparatus according to the third exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus that transfers a first image including a first toner not containing a metal pigment onto a specific medium having a smoothness of 112 seconds or smaller, fixes the first image for use as a base coat onto the specific medium, and transfers and fixes a second image including a second toner containing a metal pigment onto the base coat fixed onto the specific medium.

2. The image forming apparatus according to claim 1, wherein the metal pigment have a flat shape.

3. The image forming apparatus according to claim 2, wherein a fixing temperature at which the first image is fixed to the specific medium for use as the base coat is higher than a fixing temperature at which only the first image is fixed to the specific medium.

4. The image forming apparatus according to claim 3, wherein a fixing speed at which the first image is fixed to the specific medium for use as the base coat is lower than a fixing speed at which only the first image is fixed to the specific medium.

5. The image forming apparatus according to claim 4, wherein a toner density of the first image at which the first image is fixed to the specific medium for use as the base coat is higher than a toner density of the first image at which only the first image is fixed to the specific medium.

6. The image forming apparatus according to claim 3, wherein a toner density of the first image at which the first image is fixed to the specific medium for use as the base coat is higher than a toner density of the first image at which only the first image is fixed to the specific medium.

7. The image forming apparatus according to claim 2, wherein a fixing speed at which the first image is fixed to the specific medium for use as the base coat is lower than a fixing speed at which only the first image is fixed to the specific medium.

8. The image forming apparatus according to claim 7, wherein a toner density of the first image at which the first image is fixed to the specific medium for use as the base coat is higher than a toner density of the first image at which only the first image is fixed to the specific medium.

9. The image forming apparatus according to claim 2, wherein a toner density of the first image at which the first image is fixed to the specific medium for use as the base coat is higher than a toner density of the first image at which only the first image is fixed to the specific medium.

10. The image forming apparatus according to claim 2 that transfers and fixes to a medium an image including a third toner different from the first toner and not containing a metal pigment, wherein a low-temperature storage elastic modulus of the first toner measured within a temperature range of 30° C. to 50° C. is smaller than a low-temperature storage elastic modulus of the third toner measured within a temperature range of 30° C. to 50° C.

11. The image forming apparatus according to claim 1, wherein a fixing temperature at which the first image is fixed to the specific medium for use as the base coat is higher than a fixing temperature at which only the first image is fixed to the specific medium.

12. The image forming apparatus according to claim 11, wherein a fixing speed at which the first image is fixed to the specific medium for use as the base coat is lower than a fixing speed at which only the first image is fixed to the specific medium.

13. The image forming apparatus according to claim 12, wherein a toner density of the first image at which the first image is fixed to the specific medium for use as the base coat is higher than a toner density of the first image at which only the first image is fixed to the specific medium.

14. The image forming apparatus according to claim 11, wherein a toner density of the first image at which the first image is fixed to the specific medium for use as the base coat is higher than a toner density of the first image at which only the first image is fixed to the specific medium.

15. The image forming apparatus according to claim 1, wherein a fixing speed at which the first image is fixed to the specific medium for use as the base coat is lower than a fixing speed at which only the first image is fixed to the specific medium.

16. The image forming apparatus according to claim 15, wherein a toner density of the first image at which the first image is fixed to the specific medium for use as the base coat is higher than a toner density of the first image at which only the first image is fixed to the specific medium.

17. The image forming apparatus according to claim 1, wherein a toner density of the first image at which the first image is fixed to the specific medium for use as the base coat is higher than a toner density of the first image at which only the first image is fixed to the specific medium.

18. The image forming apparatus according to claim 1, wherein the first toner is colorless.

19. The image forming apparatus according to claim 1, wherein the first toner is white.

20. The image forming apparatus according to claim 1 that transfers and fixes to a medium an image including a third toner different from the first toner and not containing a metal pigment, wherein a low-temperature storage elastic modulus of the first toner measured within a temperature range of 30° C. to 50° C. is smaller than a low-temperature storage elastic modulus of the third toner measured within a temperature range of 30° C. to 50° C.

* * * * *